United States Patent [19]

Kurosawa et al.

[11] Patent Number: 4,776,487

[45] Date of Patent: Oct. 11, 1988

[54] CONTROL DEVICE FOR A VENDING MACHINE DISPENSING MECHANISM

[75] Inventors: Akihito Kurosawa; Osamu Anazawa, both of Maebashi; Daigo Sunouchi; Masayuki Yoshihara, both of Isesaki, all of Japan

[73] Assignee: Sanden Corporation, Japan

[21] Appl. No.: 75,184

[22] Filed: Jul. 17, 1987

Related U.S. Application Data

[63] Continuation of Ser. No. 814,792, Dec. 30, 1985, abandoned.

[30] Foreign Application Priority Data

Dec. 28, 1984 [JP] Japan ..... 59-196712[U]
Dec. 28, 1984 [JP] Japan ..... 59-196713[U]

[51] Int. Cl.[4] ..... G07F 11/00

[52] U.S. Cl. ..... 221/2; 221/13; 221/21; 221/116

[58] Field of Search ..... 221/9, 12, 13, 15, 16, 221/21, 116–118, 251, 298, 114, 129, 131; 222/642–643

[56] References Cited

U.S. PATENT DOCUMENTS

| | | | |
|---|---|---|---|
| 3,795,343 | 3/1974 | Shigemori et al. | 221/21 |
| 3,998,357 | 12/1976 | Levasseut | 221/21 |
| 4,356,829 | 11/1982 | Furuya et al. | 221/21 |
| 4,542,834 | 9/1985 | Kurosawa et al. | 221/251 |
| 4,565,300 | 1/1986 | Kokubun et al. | 221/116 |
| 4,574,980 | 3/1986 | Kurosawa et al. | 221/116 |

*Primary Examiner*—H. Grant Skaggs
*Attorney, Agent, or Firm*—Banner, Birch, McKie & Beckett

[57] ABSTRACT

An article dispenser for dispensing articles from a vending machine is disclosed. The article dispenser includes an article storage area which has a bottom opening through which articles are dispensed and an article dispensing mechanism which dispenses the lowermost articles stacked in the storage area through the bottom opening. The dispensing mechanism includes a rotating shaft which controls the opening and closing of the bottom opening of the storage area and is driven by a motor. The motor is controlled by a control device which starts the motor after receiving a start signal and which temporarily stops the motor after receiving a motor stop signal.

11 Claims, 7 Drawing Sheets

40
+12V
D
CP
Q
CL
CR
405
TD
403
E
B
A
Q0
Q1
Q2
Q3
404
CL
CE
CP
42
43
TU
RS
401
402
41
T1
T2
CD
FW
S
MO
FROM A 180° SENSOR 28
FROM A VENDING SWITCH
TO MOTOR 21

CONTROL DEVICE FOR A VENDING MACHINE DISPENSING MECHANISM

This application is a continuation of application Ser. No. 814,792, filed Dec. 30, 1985, now abandoned.

BACKGROUND OF THE INVENTION

This invention relates to the field of vending machines, and more particularly, is directed to an improved control device for the dispensing mechanism in a vending machine.

Various types of dispensing mechanisms for vending machines have been used in the prior art depending on the type of food products or goods being vended. One well known type of dispensing mechanism uses a flapper device. This type of dispensing mechanism is adapted to dispense rectangular or cube shaped paper cartons containing a beverage or other liquid.

The basic construction of a flapper type dispensinng mechanism is shown in U.S. Pat. No. 4,542,834. This type of dispensing mechanism includes a rotating shaft which vertically extends into the storage area of the vending machine to divide the storage area into two vertical rows or columns stacked with vending articles. A control plate is fixed on the lower end of the rotating shaft and controls the operation of a pair of flappers positioned below the two vertical rows of articles. As the flappers open and close upon rotation of the shaft, the lowermost article in the rows are dispensed.

In this construction of a flapper type dispensing mechanism, the articles stacked above the lowermost article adjacent the flappers is held in position by a holding apparatus during the dispensing operation. The holding apparatus may be connected to the rotating shaft and be automatically positioned by the shaft to hold the upper articles in place, e.g., by pressing the article(s) against the interior of the vertical rows. Operation of the holding apparatus is, therefore, quite likely to result in some deformation of the outer shape of the articles. As a result of the deformation, smooth operation of the dispensing mechanism will be impaired. Moreover, the time for completely dispensing an article from the dispensing mechanism will also increase. Also, the rotating shaft is usually operated by a motor which is controlled by a timer device. Thus, if the dispensing operation takes too much time, the shaft will begin turning before the dispensed article has cleared the flapper into the discharge opening. Accordingly, the dispensing mechanism is likely to become jammed.

In prior art dispensing mechanisms, the mechanism is usually provided with a protective circuit which turns the motor off after a predetermined time period has passed. Though the motor is protected from damage by the protective circuit, the vending machine remains inoperative even when articles are still stored within the dispensing mechanism.

SUMMARY OF THE INVENTION

It is a primary object of this invention to provide a simple dispensing mechanism for vending machines in which a stuck condition is easily prevented.

It is another object of this invention to provide a dispensing mechanism for vending machines in which a dispensing operation is easily accomplished free from the adverse effects due to deformation of the articles.

It is a further object of this invention to provide an improved dispensing mechanism which may be readily utilized with conventional dispensing machines.

A dispensing mechanism for vending machines according to this invention includes an article storage area for storing articles in a stacked position above a bottom opening through which one or more articles are dispensed. The dispensing mechanism includes a pair of flappers which are rotatably supported at the lower end of the storage area and are disposed for covering the bottom opening of the storage area. A control plate is attached to the lower end of a motor driven rotating shaft and contacts the back surface of the flappers to control the pivoting of the flappers upon rotation of the rotating shaft. A motor control device is provided to control the operation of the motor. The motor control device stops the operation of the motor while the article dispensing operation is taking place.

Further objects, features and other aspects of this invention will be understood from the following detailed description of the preferred embodiments with reference to the annexed drawings.

FIG. **12*a*–12*c*** are time-line charts illustrating various logic signals in the motor control device depending upon the rotation of the rotating shaft.

DETAILED DESCRIPTION OF THE PREFERRED EMBODIMENTS

Figure 1:
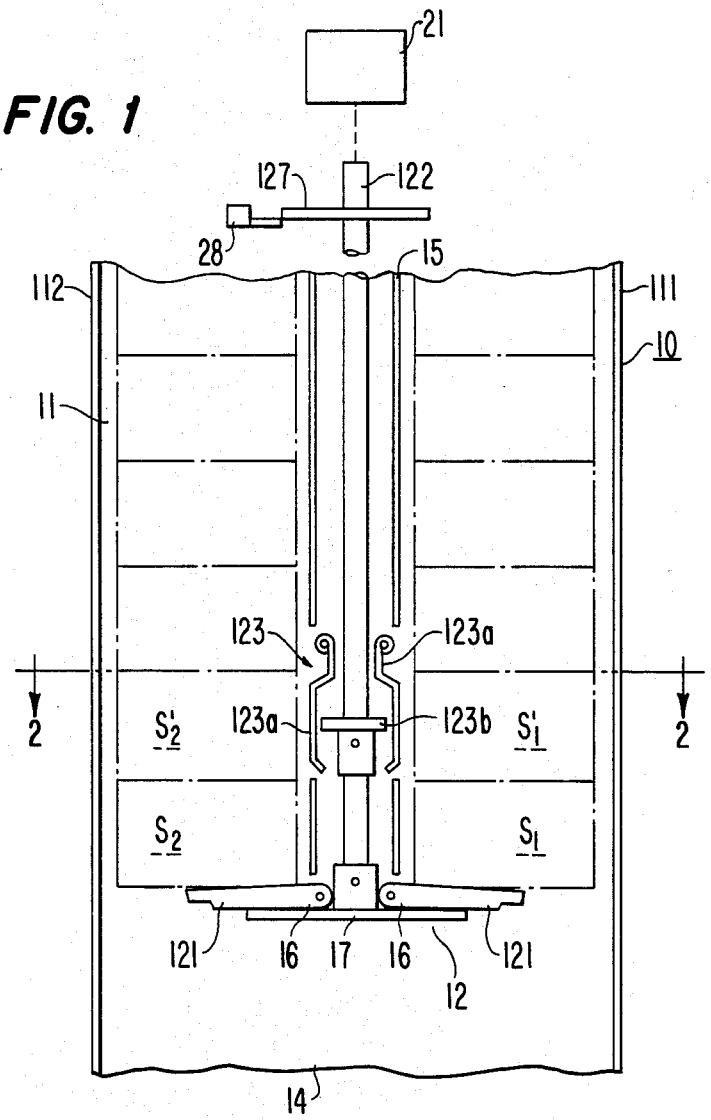
FIG. 1 is a partial front end view of an article dispensing mechanism according to the invention.
Figure 2:
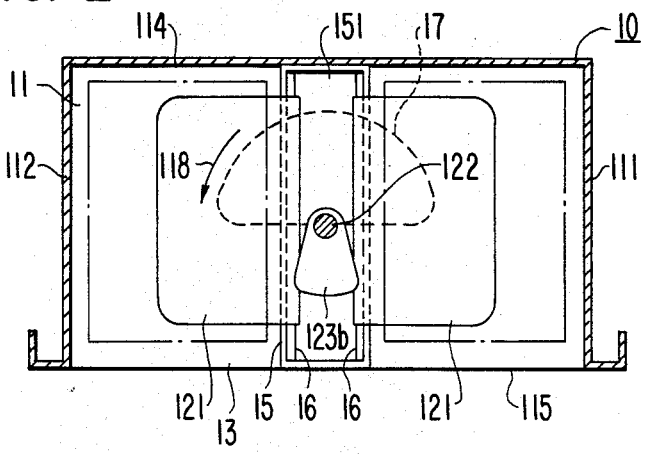
FIG. 2 is a sectional view taken along line 2—2 in FIG. 1.

Referring to FIGS. 1 and 2, a dispensing unit 10, including a motor control device in accordance with the present invention, is shown. The dispensing unit 10 includes article storage area 11 and article dispensing mechanism 12. Article storage area 11 comprises vertically disposed side plates 111, 112, an upper plate (not shown) and a back plate 114, each of which is connected with one another to form a U-shaped cross-section as shown in FIG. 2. Front support plate 115 is connected across the lower front portion of side plates 111, 112. Front opening 13, which is formed between side plates 111, 112, and the upper plate (not shown) and support plate 115, is used to load articles into storage area 11. Storage area 11 has a bottom discharge opening 14 through which articles are dispensed. Storage area 11 is also divided into two vertical columns by divider plate 15 which vertically extends through the center portion of storage area 11 and has a rectangular shaped space 151 therein. Thus, the articles S are stored in the columns formed on both sides of divider plate 15.

Article dispensing mechanism 12 is disposed within article storage area 11 and comprises a pair of rectangularly shaped flappers 121, rotating shaft 122, holding apparatus 123 and a driving mechanism for rotating shaft 122. Each of flappers 121 is pivotably supported by a hinge element 16 which is removably disposed on front plate 115 and back plate 114, respectively, below divider plate 15. As shown in FIG. 1, flappers 121 are disposed in discharge opening 14 of storage area 11, i.e., flappers 121 are positioned below each of the columns formed by divider plate 15 to control the opening and closing of discharge opening 14.

In accordance with the teachings of U.S. Pat. No. 4,542,834, a cam plate 127 is attached to or comprises a portion of rotating shaft 122. Cut-outs (not shown) are provided to indicate shaft 122 rotations of various angular positions, for example, 90° and 180° from an initial position. Plural detectors comprising microswitches and levels 28 report shaft position signals to the motor control device of the present invention.

Rotating shaft 122 vertically extends into space 151 of divider plate 15. The lower end portion of rotating shaft 122 is rotatably supported by a support element which is fixed to and extends from the inner surface of back plate 114. The upper end portion of rotating shaft 122 is connected to a driving mechanism which is disposed on the upper plate and includes a motor 21 for driving rotating shaft 122.

Rotating shaft 122 has an arc shaped control plate 17 at its lower end portion. Control plate 17 contacts the lower or back surface of flappers 121. When control plate 17 is in engagement with the lower surface of both flappers 121, the flappers are forced in a horizontal position. Thus, control palte 17 controls the pivoting of flappers 121 to prevent discharge of any articles from storage area 11. When control plate 17 is rotated by the operation of rotating shaft 122 to contact only one of flappers 121, the other flapper pivots to an open position to permit discharge of an article from the column over the respective flapper (see FIG. 3).

Figure 3:
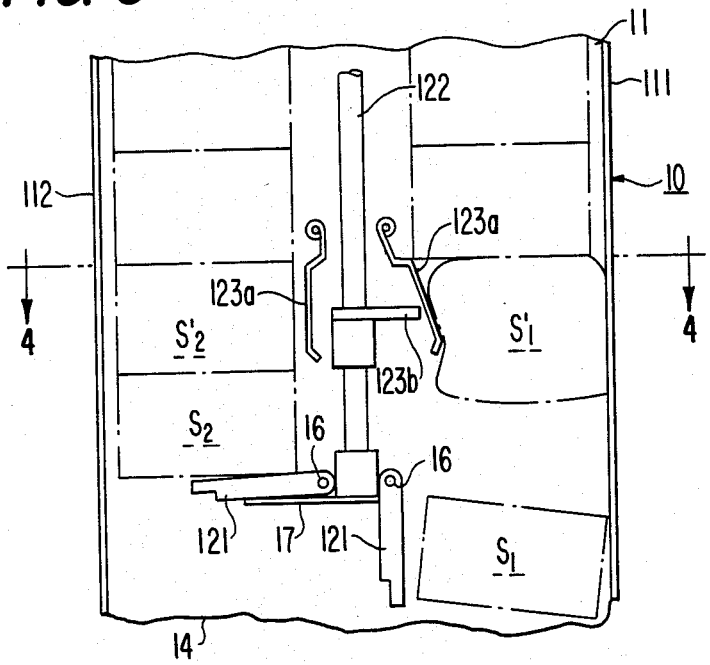
FIG. 3 is a partial front end view of the article dispensing mechanism of FIG. 1 illustrating its dispensing operation.

Holding apparatus 123, which comprises a pair of levers **123*a*, is pivotably supported within space 151 of divider plate 15. An arc shaped pushing element 123*b* is attached to rotating shaft 122 and is disposed in article storage area 11 at a position adjacent the lower portion of driving shaft 122. As shown in FIG. 2, holding apparatus 123 is aligned with articles $S_1'$, $S_2'$ which are stacked above lowermost articles $S_1$, $S_2$ on the upper surface of flappers 121. As shown in FIG. 3, one or the other of levers 123*a* is pushed against a respective article $S_1'$ or $S_2'$ by the rotation of pushing element 123*b* driven by rotating shaft 122. Thus, article $S_1'$ or $S_2'$ stacked above the dispensing article $S_1$ or $S_2$ can be held in position by the operation of holding apparatus 123**.

Referring to FIGS. 1–6, the operation of the article dispensing mechanism will be described. Articles or packages S containing beverages or other merchandise are loaded within storage area 11 through front opening 13 and stacked on flappers 121 to form two vertical columns. When motor 21 is energized by a signal from a vending switch, (not shown) rotating shaft 122, holding apparatus 123 and control plate 16 are rotated. The direction of rotation is, for example shown by arrow 118 in FIG. 2 to release an article in a right column of storage area 11. During the rotation of rotatable shaft 122, the outer terminal end of pushing element **123*b* comes into contact with one of levers 123*a*, thereby pushing the lever into engagement with article $S_1'$. Article $S_1'$ is therefore maintained between the lever and side plate 111. Just prior to control plate 16 being rotated away from its contact position with both flappers 121 to a position in contact with only one of the flappers, i.e., rotating shaft 122 has rotated about 90° from its initial position, article $S_1$which is stacked above lowermost article $S_1$ is securely frictionally engaged between one of levers 123*a* of holding apparatus 123 and side plate 111. Thus the articles above lowermost article $S_1$ on flappers 121** are held in their stacked position.

Figure 4:
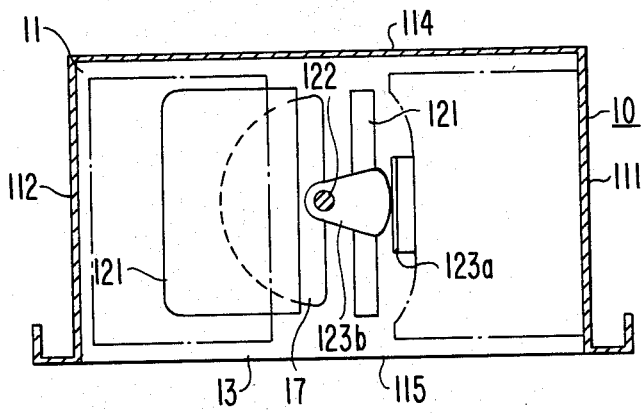
FIG. 4 is a sectional view taken along line 4—4 in FIG. 3.

When rotating shaft 122 is rotated more than 90° from its initial position, one of flappers 121 is released from its horizontal position and this one flapper pivots downward around hinge element 16. Then, as shown in FIGS. 3 and 4, article $S_1$ disposed on this one released flapper is allowed to drop to the vending area. At the same time, the other flapper 121 is maintained in its horizontal position by control plate 17. As holding apparatus 123 and control plate 17 continue to rotate, control plate 17 again contacts the one released flapper 121 and pushes it upward to its horizontal position.

Figure 5:
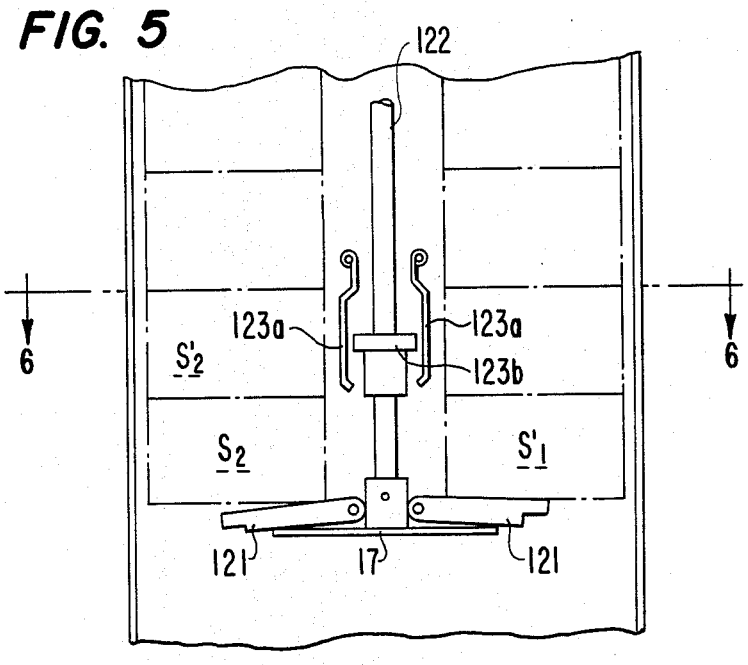
FIG. 5 is a partial front end view of the article dispensing mechanism of FIG. 1 illustrating the final operating position of the dispensing mechanism after completion of a dispensing operation.
Figure 6:
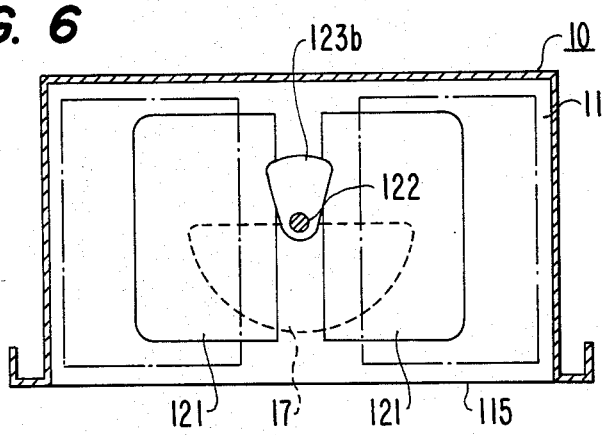
FIG. 6 is a sectional view taken along line 6—6 in FIG. 5.
Figure 7:
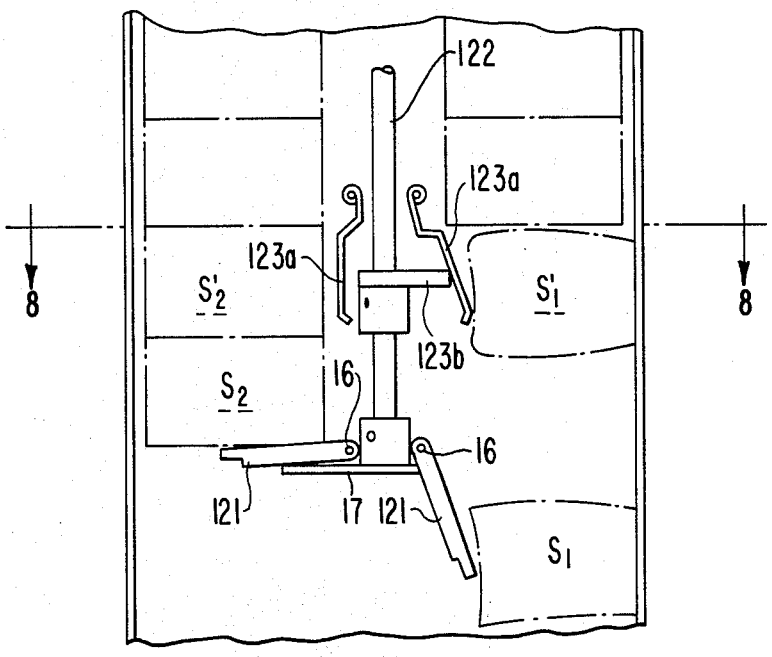
FIG. 7 is a partial front end view of the article dispensing mechanism of FIG. 1 illustrating a stuck condition.
Figure 8:
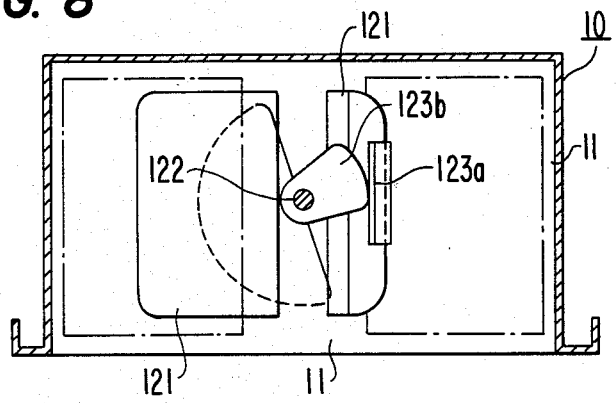
FIG. 8 is a sectional view taken along line 8—8 in FIG. 7.

After rotating shaft 122 rotates 180°, motor 21 is turned off and flappers 121 and holding apparatus 123 come to rest in the positions shown in FIGS. 5 and 6. At this time, article $S_1'$ is released from between holding apparatus 123 and side plate 111 and slides down to the top surface of flapper 121. Either of lowermost articles $S_1'$ or $S_2'$ disposed on both flappers 121 is dispensed by the next operation of the dispensing mechanism in the same manner as described above in connection with article $S_1'$.

Figure 9:
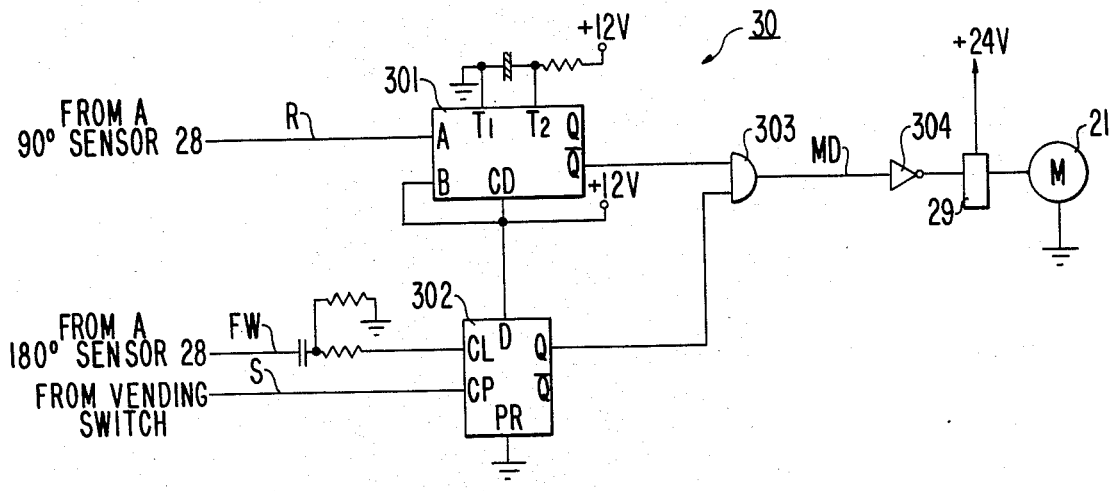
FIG. 9 is a circuit diagram of the motor control device according to one embodiment of this invention.

Referring to FIG. 9, a control device 30 for motor 21 is shown. The control device 30 comprises a timer circuit 301, flip-flop circuit 302, logic AND gate 303 and logic inverter gate 304.

A signal from a vending switch, such as a start signals, is coupled to the "CP" input terminal of flip-flop circuit 302. A reset signal FW, such as a flopper waiting signal indicating that rotating shaft 122 has rotated 180° from its initial position, is coupled to the "CL" terminal of flip-flop circuit 302. The "PR" input terminal of flip-flop circuit 302 is grounded and the "D" input terminal is maintained at a logic HI. The "Q" output terminal is connected to one of the input terminals of logic AND gate 303. The "A" input terminal of timer circuit 301 is coupled to a signal which indicates when rotating shaft 122 has rotated 90° from its initial position. Terminals "$T_1$", $T_2$, "B" and "CD" are maintained at a logic HI level and the Q output terminal is connected to the other input terminal of AND gate 303. The output terminal of AND gate 303 is connected to inverter 304 which in turn controls motor relay 29. Motor relay 29 controls the operation of motor 21.

The operation of control device 30 will be explained with reference to FIGS. 9 and 10. When the start signal S from the vending device is supplied to the "CP" terminal of flip-flop 302, i.e., the "CP" terminal rises to a logic HI, the output signal from the "Q" output terminal rises to a logic HI. This condition continues until a reset signal FW is supplied to the "CL" input terminal. During an initial period, the "A" terminal of timer circuit 301 is maintained at a logic LO. Thus the output signal from the Q terminal of timer circuit 301 is a logic HI. Therefore, the output of AND gate 303 is a logic HI. The logic HI signal is inverted by inverter 304 to a logic LO and is supplied to motor relay 29. The logic LO signal to motor relay 29 permits motor 21 to operate.

As motor 21 starts to rotate and rotating shaft 122 rotates past 90° from its initial position, a 90° rotation signal R indicating such is supplied to input "A" terminal of timer circuit 301. When this occurs, the output signal from the "$\overline{Q}$" terminal of timer circuit 301 changes from a logic HI to a logic LO. The "$\overline{Q}$" output terminal remains at a logic LO for a predetermined period of time established by timer circuit 301, e.g., one second. Thereafter, the "$\overline{Q}$" output terminal of timer circuit 301 returns to a logic HI.

When the output signal from timer circuit 301 changes to a logic LO, the output signal from AND gate 303 changes to a logic LO and thus the output of inverter 304 changes to a logic HI. Thus, motor 21 stops rotating. After the predetermined time established by timer circuit 301 expires (one second), the output signal from the timer circuit returns to a logic HI. Therefore, the output of AND gate 303 changes to a logic HI and the output of inverter 304 changes to a logic LO. Thus, motor 21 is turned on and starts to again drive rotating shaft 122. When rotating shaft 122 rotates past 180° from its initial position, a reset signal is supplied to the "CL" input terminal of flip-flop circuit 302. The output signal from the "Q" terminal of flip-flop circuit 302 changes from a logic HI to a logic LO. Accordingly, the output of AND gate 303 changes to a logic LO and the output of inverter 304 changes to a logic HI. Thus, motor 21 is turned off, completing a cycle of operation for the dispensing mechanism.

Figure 10:
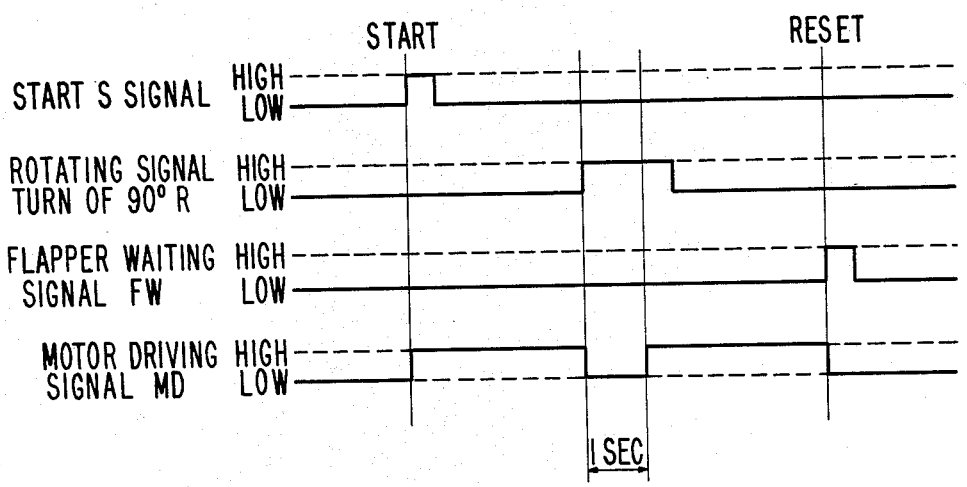
FIG. 10 is a time-line chart illustrating various logic signals in the motor control device of FIG. 9.

FIG. 10 is a time-line chart illustrating the time sequence of the various signals discussed above.

Figure 11:
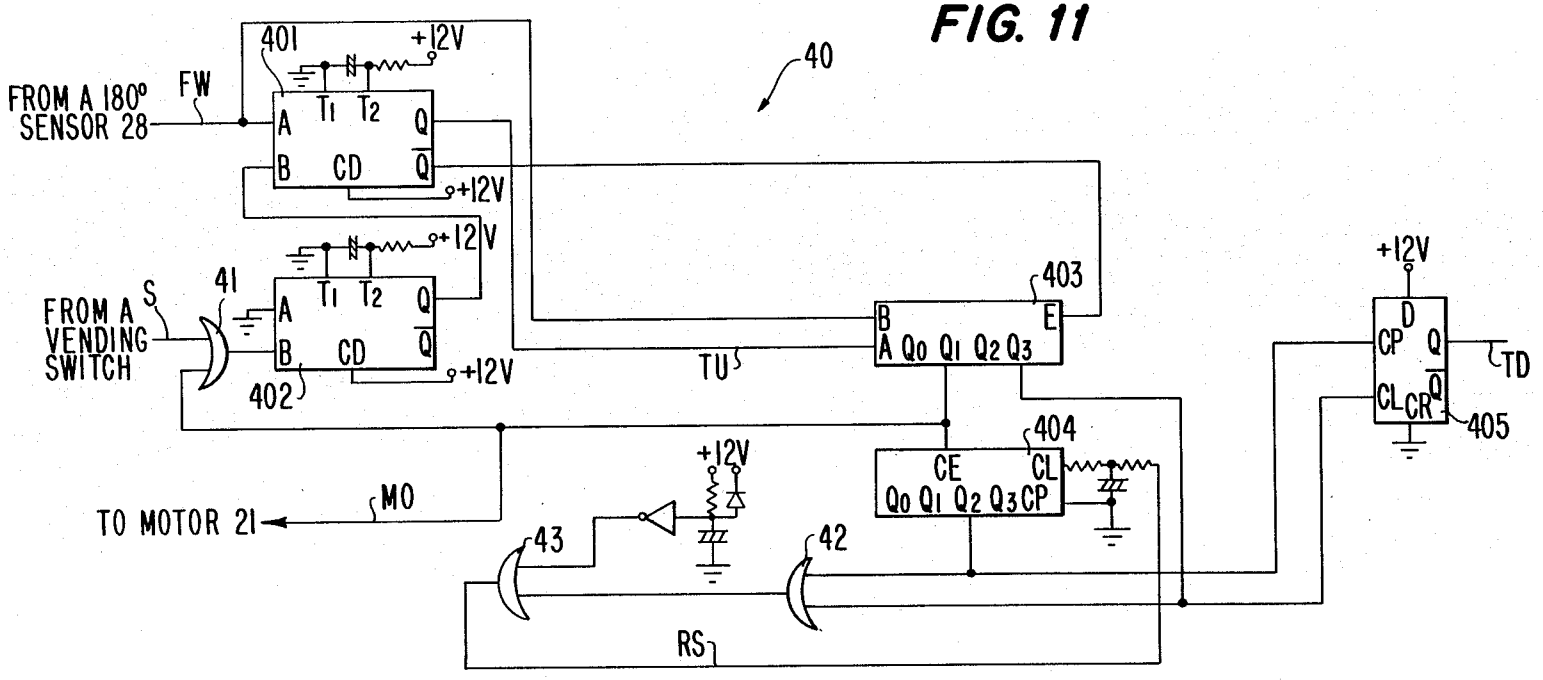
FIG. 11 is a circuit diagram of the motor control device according to another embodiment of this invention.

Referring to FIGS. 11 and 12, another embodiment of the present invention is shown. In this embodiment, control device 40 comprises two timer circuit 401, 402, a decoder 403, a counter 404 and a flip-flop circuit 405. The "B" input terminal of timer circuit 402 is connected to the output terminal of logic OR gate 41. A start signal S from the vending switch for the dispensing mechanism is coupled to one of the input terminals of OR gate 41. The "CD" and "$T_2$" input terminals of timer circuit 402 are maintained at a logic HI and the "$T_1$" input terminal is grounded, i.e., maintained at a logic LO. The "Q" output terminal of timer circuit 402 is connected to the "B" input terminal of timer circuit 401.

A stationary position signal FW indicating that flappers 121 are in a stationary position is supplied to input terminal "A" of timer circuit 401. The "CD" and "$T_2$" terminals of timer circuit 401 are maintained at a logic HI level and input terminal "$T_1$" is grounded, i.e., maintained at a logic LO level. The "Q" output terminal of timer circuit 401 is connected to the "A" input terminal of decoder 403 and the "$\overline{Q}$" output terminal is connected to the "E" input terminal of decoder 403. The "B" input terminal of decoder 403 is connected to the "A" input terminal of timer circuit 401, i.e., the stationary position signal FW from flappers 121 is also connected to the "B" input terminal of decoder 403. The "$Q_1$" output terminal of decoder 403 is connected to the other input terminal of OR gate 41 and is also connected to the "CE" input terminal of decoder 404. The "$Q_3$ output terminal of decoder 403 is connected to one of the input terminals of OR gate 42 and also is connected to the "CL" input terminal of flip-flop 405.

The "$Q_2$" output terminal of counter circuit 404 is connected to the other input terminal of OR gate 42 and is also connected to the "CP" input terminal of flip-flop circuit 405. The output terminal of OR gate 42 is connected to one of the input terminals of OR gate 43. The other input terminal of OR gate 43 is maintained low through inverter 44. The output signal from OR gate 43 is supplied to the "CL" input terminal of counter circuit 404. The "CP" input terminal of counter circuit 404 is maintained at a logic LO. Therefore, the restart signal for the operation of motor 21 is provided from the "$Q_1$" output termminal of decoder 403 and the reset signal RS for the dispensing mechanism is provided from the output terminal of OR gate 43. A trouble detecting signal TD is also provided from the "Q" output terminal of flip-flop circuit 405.

When a start signal S is received from the vending switch in the form of a logic HI to LO transition and supplied to an input terminal of OR gate 41, a corresponding signal is supplied to input terminal B of timer circuit 402. Therefore, the "Q" terminal of timer circuit 402 rises to a logic HI level after a predetermined time period from the occurrence of the start signal. In this embodiment, this predetermined time is, e.g., 6 seconds.

Figure 12A:
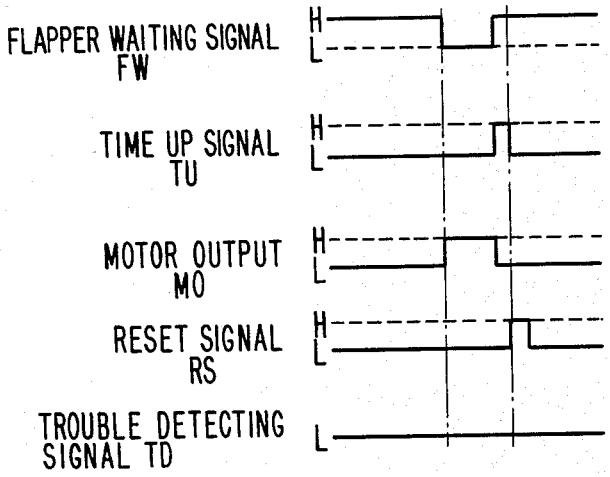

The flapper waiting position signal FW is supplied to the "A" input terminal of timer circuit 401. This signal changes from a logic HI to a logic LO level as motor 21 begins to drive rotating shaft 121. In normal operation, rotating shaft 122 rotates 180° within 6 seconds from the occurrence of the start signal. When rotating shaft 122 is rotated 180°, the flapper waiting position signal changes to a logic HI from a logic LO level. When this occurs, a logic HI signal is output from the "Q" output terminal of timer circuit 401 to the "A" input terminal of decoder 403. This signal is referred to as the time up signal TU and is shown in FIG. 12*a*. The time up signal is provided after a predetermined time period and in this embodiment is, e.g., one second. When the time up signal TU is provided, the "Q" output terminal of timer circuit 401 is at a logic LO level and the flapper waiting position signal FW, which is at a HI level, is supplied to the "B" input terminal of decoder 403. Therefore, a logic LO level signal is output from the "$Q_1$" output terminal of decoder 403 and a logic HI level signal is output from the "$Q_3$" output terminal of the decoder. When a logic LO level signal is provided on the "CE" terminal of counter 404, a logic LO level signal is output from the "$Q_2$" output terminal of counter 404.

Since a logic HI level signal is output from the "$Q_3$" terminal of decoder 403, the reset pulse signal RS shown in FIG. 12(a) is output from OR gate 42 and 43 respectively thereby reseting the dispensing mechanism. Furthermore, the logic HI level signal from the "$Q_3$" output terminal of decoder 403 is provided to the "CL" input terminal of flip-flop 405. Thus, the "Q" output terminal of flip-flop 405 is maintained at a logic LO regardless of the logic state of the signal at the "CP" input terminal of the flip-flop.

During the operation of the dispensing mechanism, if a dispensing article becomes stuck between one of the flappers and the side wall of the storage area, the operation of motor 21 is stopped and rotating shaft 122 cannot provide the flapper waiting position signal FW within the required 6 seconds, i.e., a logic HI level signal is provided to the "B" input terminal of timer circuit 401 even if the flapper waiting position signal FW is at a LO logic level. As a result of this condition, a time up signal TU is output from the "Q" output terminal of timer circuit 401.

When a logic LO level signal is input to the "E" and "B" terminals of decoder 403 and a logic HI level signal is input to the "A" terminal, the "$Q_1$" terminal outputs a logic HI level and the "$Q_3$" terminal outputs a logic LO level. Furthermore, the output signal from the "$Q_2$" terminal of counter 404 changes to a logic LO level when a predetermined number of pulse signals are input to the "CE" terminal of counter 404. In this embodiment, the number of pulse signals is, e.g., 4. Therefore, the output signal from the "$Q_2$" terminal is maintained at a logic LO level even if the signal provided to the "CL" input terminal of flip-flop 405 is maintained at a logic LO level, i.e., the reset signal and a trouble detecting signal are not produced.

Figure 12B:
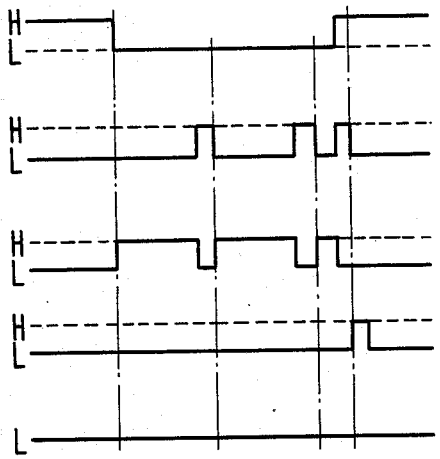

Referring to FIG. 12*b*, the time up signal TU is provided to motor relay 29 to stop the operation of motor 21 after 1 second. As mentioned above, the time up signal is supplied to an input terminal of OR gate 41. Thus, a logic HI level signal is output from the "Q" terminal of second timer circuit 402 after the predetermined time from the occurrence of the time up signal has passed, i.e., 6 seconds. If rotating shaft 122 has produced the flapper waiting position signal FW, the output signal from OR gate 43 is changed to a logic HI level. Thus, counter 404 is reset and a trouble detecting signal is not produced.

Figure 12C:
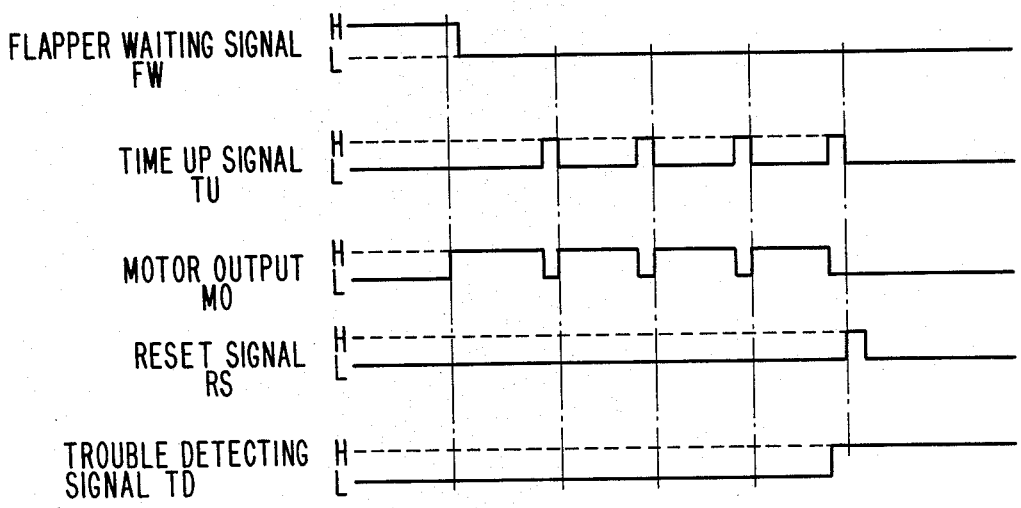

Referring to FIG. 12*c*, if the motor 21 remains stopped for a prolonged period of time due to an article being stuck and the time up signal TU is output four times, the "$Q_2$" output terminal of counter 404 and the "Q" output terminal of flip-flop 405 changes to a logic HI level, i.e., a trouble detecting signal TD is produced. On the other hand, the output signal RS from OR gate 43 is changed to a logic HI level which is provided to the "CL" terminal of counter 404 to thereby reset counter 404. Therefore, the operation of the dispensing mechanism totally ceases.

As mentioned above, in accordance with FIG. 12*b* the motor control device temporarily stops the operation of motor 21 if a temporary hanging or stuck condition is detected. Therefore, even if the dispensing article is stuck between the flapper and side walls of the article storage area, the article has a change to release itself for dispensing due to its weight. Also in accordance with FIG. 12*c*, the operation of motor 21 is totally ceased after intermittent operation of the motor occurs several times, and the article does not release itself.

This invention has been described in detail in connection with the preferred embodiments. These embodiments are merely for example only and this invention is not restricted thereto. It will be easily understood by those skilled in the art that other variations and modifications can be easily made within the scope of this invention, as defined by the appended claims.

We claim:

1. In a dispensing mechanism for vending machines including an article storage area in which the articles are held in two vertically adjacent rows in a stacked disposition above a bottom opening through which the lowermost articles are dispensed and a dispensing mechanism to dispense the lowermost articles stacked in said storage area through said bottom opening, said dispensing mechanism including means for retaining the upper articles while the lowermost articles are being dispensed, a rotating shaft vertically extending within said storage area between the two vertically adjacent rows, a pair of flappers pivotably supported within said storage area adjacent to the lower end of said rotating shaft to cover the bottom opening in said storage area and control plate means fixed on the lower end of said rotatable shaft in contact with the lower surface of said flappers for controlling the pivoting of each of said flappers upon the rotation of said rotatable shaft to selectively open and close said flappers to dispense the lowermost stacked articles in the two vertically adjacent rows, said rotating shaft being driven by a motor, the improvement comprising said dispensing mechanism being provided with a motor control device which starts up the operation of said motor after receiving a dispensing signal to start a dispensing operation and at least temporarily stops the operation of said motor during the dispensing operation, said motor control device being further responsive to a motor stop signal provided during the dispensing operation by inhibiting the operation of the motor for a predetermined period of time.

2. The dispensing mechanism for vending machines of claim 1 wherein the motor stop signal corresponds to a predetermined rotating angle of said rotating shaft, wherein said selectively opened flapper is maintained open for the predetermined time.

3. In a dispensing mechanism for vending machines including an article storage area in which the articles are held in two vertically adjacent rows in a stacked disposition above a bottom opening through which the lowermost articles are dispensed and a dispensing mechanism to dispense the lowermost articles stacked in said storage area through said bottom opening, said dispensing mechanism including means for retaining the upper articles while the lowermost articles are being dispensed, a rotating shaft vertically extending within said storage area between the two vertically adjacent rows, a pair of flappers pivotably supported within said storage area adjacent to the lower end of said rotating shaft to cover the bottom opening in said storage area and control plate means fixed on the lower end of said rotatable shaft in contact with the lower surface of said flappers for controlling the pivoting of each of said flappers upon the rotation of said rotatable shaft to selectively open and close said flappers to dispense the lowermost stacked articles in the two vertically adjacent rows, said rotating shaft being driven by a motor, the improvement comprising said dispensing mechanism being provided with a motor control device which starts up the operation of said motor after receiving a dispensing signal to start a dispensing operation and at least temporarily stops the operation of said motor during the dispensing operation, said motor control device being further responsive to a motor stop signal wherein said motor stop signal is produced by a detecting device which detects an article hanging condition in said dispensing mechanism, said motor control device being adapted to inhibit the operation of said motor if a flapper signal is not received within a predetermined time period and, thereafter provide a restart signal to restart said motor, said motor control device being further adapted to provide said restart signal a predetermined number of times before stopping said motor and providing a trouble detecting signal to indicate that the vending machine is malfunctioning.

4. In a dispensing mechanism for vending machines including an article storage area in which the articles are held in a plurality of vertical rows in a stacked disposition above a bottom opening through which the lowermost articles are dispensed and a dispensing mechanism to dispense the lowermost articles stacked in said storage area through said bottom opening, said dispensing mechanism including means for retaining the upper articles while the lowermost articles are being dispensed, a rotatable shaft, a flapper for each of said plurality of vertical rows pivotably supported within said storage area adjacent to an end of said rotatable shaft to cover the bottom opening in said storage area and control plate means fixed on said end of said rotatable shaft in contact with the lower surface of said flappers for controlling the pivoting of each of said flappers upon rotation of said rotatable shaft to selectively move said flappers to dispense the lowermost stacked articles in said vertical rows, said rotatable shaft being driven by a motor, the improvement comprising:

dispensing signal means for providing a dispensing signal to start a dispensing operation;

wait signal means for providing a wait signal during the dispensing operation;

reset signal means for providing a reset signal to end a dispensing operation; and motor control means coupled to said dispensing signal means, said reset signal means and said wait signal means for receiving said dispensing signal, said wait signal and said reset signal and controlling said motor in accordance with said signals, wherein said motor control means starts the operation of said motor upon receiving said dispensing signal and inhibits the operation of said motor for a predetermined period of time upon receiving said wait signal, whereafter said control means restarts the operation of said motor until said reset signal is received.

5. The dispensing mechanism for vending machines of claim 4 wherein said motor control means includes a logic flip-flop circuit having a clock input, a reset input, and an output for providing an output signal from said flip-flop, said clock input receiving said dispensing signal and said reset input receiving said reset signal, the output signal from said output being used at least in part to control the operation of said motor.

6. The dispensing mechanism for vending machines of claim 5 wherein said motor control means includes timer means having an input and an output for providing a timing function, the input of said timing means receiving said wait signal, upon receipt of said wait signal said timing means providing a timing signal at its output having a duration of said predetermined period of time, said timing signal being used at least in part to control the operation of said motor.

7. The dispensing mechanism for vending machines of claim 4 wherein said wait signal corresponds to a 90° rotation of said rotatable shaft.

8. The dispensing mechanism for vending machines of claim 4 wherein said reset signal corresponds to a 180° rotation of said rotatable shaft.

9. In a dispensing mechanism for vending machines including an article storage area in which the articles are held in a plurality of vertical rows in a stacked disposition above a bottom opening, said dispensing mechanism including means for retaining the upper articles while the lowermost articles are being dispensed, a rotatable shaft, a flapper for each of said plurality of vertical rows pivotably supported within said storage area adjacent to an end of said rotatable shaft to cover the bottom opening in said storage area and control plate means fixed on said end of said rotatable shaft in contact with the lower surface of said flappers for controlling the pivoting of each of said flappers upon rotation of said rotatable shaft to selectively move said flappers to dispense the lowermost stacked articles in said vertical rows, said rotatable shaft being driven by a motor, the improvement comprising:

dispensing signal means for providing a dispensing signal to start a dispensing operation;

wait signal means for providing a wait signal during the dispensing operation;

reset signal means for providing a reset signal to end a dispensing operation; and motor control means coupled to said dispensing signal means, said reset signal means and said wait signal means for receiving said dispensing signal, said wait signal and said reset signal and controlling said motor in accordance with said signals, wherein said motor control means starts the operation of said motor upon receiving said dispensing signal and inhibits the operation of said motor for a predetermined period of time upon receiving said wait signal, whereafter said control means restarts the operation of said motor until said reset signal is received, said motor control means including:

a logic flip-flop circuit having a clock input, a reset input, and an output for providing an output signal from said flip-flop, said clock input receiving said dispensing signal and said reset input receiving said reset signal, the output signal from said output being used at least in part to control the operation of said motor;

timer means having an input and an output for providing a timing function, the input of said timing means receiving said wait signal, upon receipt of said wait signal said timing means providing a timing signal at its output having a duration of said predetermined period of time, said timing signal being used at least in part to control the operation of said motor; and a logic AND circuit having at least two inputs and an ouput, one input receiving said output signal from said logic flip-flop and another input receiving said timing signal, the output signal from said logic AND circuit being used to control said motor.

10. In a dispensing mechanism for vending machines including an article storage area in which the articles are held in a plurality of vertical rows in a stacked disposition above a bottom opening through which the lowermost articles are dispensed and a dispensing mechanism to dispense the lowermost articles stacked in said storage area through said bottom opening, said dispensing mechanism including means for retaining the upper articles while the lowermost articles are being dispensed, a rotatable shaft, a flapper for each of said plurality of vertical rows pivotably supported within said storage area adjacent to an end of said rotatable shaft to cover the bottom opening in said storage area and control plate means fixed on said end of said rotatable shaft in contact with the lower surface of said flappers for controlling the pivoting of each of said flappers upon rotation of said rotatable shaft to selectively move said flappers to dispense the lowermost stacked articles in said vertical rows, said rotatable shaft being driven by a motor, the improvement comprising:

dispensing signal means for providing a dispensing signal to start a dispensing operation;

flapper signal means for providing a flapper signal which can have a first logic state and a second logic state, said flapper signal being at said first logic state at least immediately prior to an occurrence of said dispensing signal; and motor control means coupled to said dispensing signal means and said flapper signal means for receiving said dispensing signal and flapper signal and controlling said motor in accordance with said signals, wherein said motor control means starts the operation of said motor upon receiving said dispensing signal, said flapper signal changing to said second logic state upon the start of rotation of said rotatable shaft driven by said motor, said flapper signal changing to said first logic state when said rotatable shaft rotates a predetermined angular distance, said motor control means stopping the operation of said motor if said flapper signal has not changed to said first logic state within a predetermined period of time.

11. The dispensing mechanism of claim 10 wherein said motor control means includes time-up signal means for providing a default signal when said flapper signal has not changed to said first logic state within said predetermined period of time, said default signal being used to inhibit the operation of said motor

* * * * *